US009725194B2

(12) United States Patent
Ballestrazzi et al.

(10) Patent No.: US 9,725,194 B2
(45) Date of Patent: Aug. 8, 2017

(54) FOLDING ASSEMBLY OF A CONTINUOUS SHEET OF PACKAGING MATERIAL, IN PARTICULAR PAPER, APPLICABLE TO AUTOMATIC PACKAGING MACHINES AND AN AUTOMATIC PACKAGING MACHINE COMPRISING SUCH A FOLDING ASSEMBLY

(71) Applicant: SITMA MACHINERY S.p.A., Spilamberto (IT)

(72) Inventors: Aris Ballestrazzi, Savignano Sul Panaro (IT); Lamberto Tassi, Savignano Sul Panaro (IT)

(73) Assignee: SITMA MACHINERY S.p.A., Spilamberto (IT)

( * ) Notice: Subject to any disclaimer, the term of this patent is extended or adjusted under 35 U.S.C. 154(b) by 571 days.

(21) Appl. No.: 14/218,096

(22) Filed: Mar. 18, 2014

(65) Prior Publication Data

US 2014/0274637 A1 Sep. 18, 2014

(30) Foreign Application Priority Data

Mar. 18, 2013 (IT) ..... MI2013A0406

(51) Int. Cl.
*B65B 9/06* (2012.01)

(52) U.S. Cl.
CPC ..... *B65B 9/06* (2013.01); *B31B 2219/2627* (2013.01); *B31B 2219/2681* (2013.01); *B65B 2009/063* (2013.01)

(58) Field of Classification Search
CPC .. B65B 9/06; B65B 9/22; B65B 9/067; B65B 9/207; B65B 2009/063; B31F 1/0012
(Continued)

(56) References Cited

U.S. PATENT DOCUMENTS 1,417,591 A * 5/1922 Anderson ..... B65B 5/04 53/131.2
2,262,792 A * 11/1941 Bray ..... A43D 8/40 493/405

(Continued)

FOREIGN PATENT DOCUMENTS

CA 2 484 892 A1 4/2006
CH 686036 A5 * 12/1995 ..... B29C 53/48

(Continued)

OTHER PUBLICATIONS

Italian Search Report issued Dec. 5, 2013, in Patent Application No. IT MI20130406, filed Mar. 18, 2013 (with English Translation of Category of Cited Documents).

*Primary Examiner* — Thanh Truong
*Assistant Examiner* — Dariush Seif
(74) *Attorney, Agent, or Firm* — Oblon, McClelland, Maier & Neustadt, L.L.P.

(57) ABSTRACT

An automatic packaging machine including a folding assembly of a continuous sheet of packaging material, in particular paper, having a sliding plane for conveying the continuous sheet of packaging material along a conveying direction is disclosed. The sliding plane includes an entrance end for entering the continuous sheet of paper and two opposite sides parallel to the conveying direction. Further, the folding assembly includes a feeding assembly for feeding the continuous sheet of packaging material along a feeding plane which is substantially orthogonal to the conveying direction and defined at the entrance end of the sliding plane. The folding assembly further includes a block associated with at least one of the opposite sides of the sliding plane and a body associated with the block and provided with a cone-sector surface which supports a longitudinal flap during longitu-
(Continued)

dinal creasing and accompanies it during the folding along the longitudinal creasing.

8 Claims, 10 Drawing Sheets

(58) Field of Classification Search
USPC ..... 53/243, 550; 493/438, 356, 405, 254
See application file for complete search history.

(56) References Cited

U.S. PATENT DOCUMENTS

RE23,231 E * 5/1950 Wilson et al. ..... B65B 9/06 493/111
2,940,408 A * 6/1960 Monsees ..... B21D 5/10 29/557
3,059,549 A * 10/1962 Seiden ..... B31B 19/36 493/438
3,127,273 A * 3/1964 Monahan ..... B65B 9/06 53/442
3,398,656 A * 8/1968 Cloud ..... B31B 19/36 493/254
3,486,291 A * 12/1969 Nye ..... B65B 9/06 493/197
4,381,637 A * 5/1983 Ballestrazzi ..... B65B 41/18 493/35
4,807,426 A * 2/1989 Smith ..... B29C 65/18 156/515
4,872,302 A * 10/1989 van Eijsden ..... B65B 53/00 53/389.4
5,255,495 A * 10/1993 Kovacs ..... B65B 9/067 53/504
8,261,518 B2 * 9/2012 Stemmle ..... B65H 37/04 53/206
2006/0026930 A1 * 2/2006 Grishchenko ..... B65B 9/067 53/567
2009/0052813 A1 2/2009 Grosse-Heitmeyer et al.
2010/0037568 A1 * 2/2010 Hashimoto ..... B65B 59/04 53/551
2012/0132316 A1 * 5/2012 Nielsen ..... B65B 9/06 141/10
2014/0274637 A1 * 9/2014 Ballestrazzi ..... B65B 9/06 493/243
2014/0352259 A1 * 12/2014 Murray ..... B65B 9/2056 53/433

FOREIGN PATENT DOCUMENTS

DE 1161469 B * 1/1964 ..... B65B 9/06
DE 102007012862 B3 * 6/2008 ..... B65B 9/22
DE WO 2014170121 A1 * 10/2014 ..... B65B 57/00
GB 1008579 10/1965
GB 1008579 A * 10/1965 ..... B65B 9/06

* cited by examiner

FOLDING ASSEMBLY OF A CONTINUOUS SHEET OF PACKAGING MATERIAL, IN PARTICULAR PAPER, APPLICABLE TO AUTOMATIC PACKAGING MACHINES AND AN AUTOMATIC PACKAGING MACHINE COMPRISING SUCH A FOLDING ASSEMBLY

FIELD OF THE INVENTION

The present invention refers to a folding assembly of a continuous sheet of packaging material, in particular paper, which is applicable to automatic packaging machines and to an automatic packaging machine comprising such a folding assembly.

BACKGROUND OF THE INVENTION

Automatic packaging machines are known that operate continuously and that are of the type that is suitable for producing packages consisting of envelopes containing, inside them, a product of the type, in particular, of a printed product, be it a sheet, a folded sheet, a fascicle, an insert or similar.

Such automatic packaging machines, in particular, are suitable for producing packages the envelope of which is made up of a single front and of a back that is in turn made of two back flaps at least partially overlapping one another, in which the envelope can be closed at least at one of the opposite sides or longitudinally at the overlapping portion of the two flaps.

In these machines the products, which are made to advance one after the other and at a distance from one another, are fed onto a continuous sheet of paper which is unwound in a continuous manner from a roll, it rests on a sliding plane (in practice made up of a conveyor belt) and is transported by it along a conveying direction.

The opposite longitudinal flaps of the continuous sheet of paper on which the products have been fed are then folded one upon another so as to form the two back flaps so as to obtain a flat and continuous tubular wrapper containing inside it a plurality of products that are arranged in succession after one another and spaced apart from one another.

The flat and continuous tubular wrapper is then cut between two successive products or pressed and cut at stripes of glue that are previously applied onto the continuous sheet of paper between two successive products so as to obtain single envelopes, each containing a respective product.

As the format of the envelope varies, the width of the front and/or the width of the longitudinal flaps that form the two back flaps and/or the amount of overlapping of the latter vary, in addition to the length of the single envelope.

In these automatic packaging machines of the known type, the continuous sheet of paper is fed at the entrance of the sliding plane simultaneously to the feeding on it of the products to be packaged.

For such a purpose, the continuous sheet of paper is unwound from a roll and is fed along a feeding plane that is substantially orthogonal to the sliding plane and arranged close to the entrance end of the latter.

In practice, considering that the sliding plane lies horizontally, the continuous sheet of paper is fed from the bottom upwards along a plane that is substantially vertical close to the entrance end of the sliding plane itself.

While passing from the feeding plane (substantially vertical) to the sliding plane (horizontal), the continuous sheet of paper undergoes a deviation of about 90°.

During such a passage the continuous sheet of paper is creased longitudinally so as to define the folding lines of two longitudinal flaps thereof which are then folded one upon another on the products already fed onto the sheet itself.

For such a purpose, known packaging machines are provided with a folding assembly that is arranged close to the entrance end of the sliding plane and that comprises, for each side of the sliding plane, a block that is provided with an edge which faces the continuous sheet of paper that rises along the feeding plane and which is parallel to the feeding direction of the sheet itself so as to impress on the latter a respective longitudinal creasing that defines a respective longitudinal flap.

The known folding assembly comprises, moreover, for each side of the sliding plane, a folding bar of the corresponding longitudinal flap.

Such folding bars are supported at one end by bridge-type frame fixed astride of the sliding plane with the interposition of adjusting means for adjusting the spatial position thereof.

In particular, such adjusting means allow modifying, with different control members that are independent from one another, the distance between the two bars along the direction that is transversal with respect to that along which the continuous sheet of paper advances, the height of each bar with respect to the sliding plane, the inclination of each bar on the vertical plane and on the horizontal plane, the distance of the tip of each bar from the entrance end of the sliding plane.

As the types of paper used and as the envelope formats to be made vary, it is necessary to modify the arrangement of the folding bars so as to prevent the sheet from being torn by the creasing edge and so as to accompany the folding of the corresponding longitudinal flap on the products.

These adjustments are carried out manually by specialised workers at each change of type of paper and/or envelope format.

These adjustments therefore rely on the experience and the sensitivity of the specialised workers and require long execution time during which the packaging machine is stopped with consequent losses in terms of productivity.

The folding assemblies of the known type, moreover, due to the excessive state of tension to which the continuous sheet of paper is subject which, while passing from the feeding plane to the sliding plane, slides along the creasing edges and is folded upon itself, on the one hand, do not allow using paper having low grammage which would tear very easily and, on the other hand, make it necessary to limit the speed at which the sheet itself advances and, therefore, to slow down the production.

In known types of folding assemblies, furthermore, there are always areas of discontinuity between the blocks and the end of the corresponding folding bar arranged close to the entrance end of the sliding plane. These discontinuities negatively affect the support of the continuous sheet of paper that, at these discontinuities, tends to crumple up and become crêpe.

Finally, the folding assemblies of the known type have a complex and bulky structure.

BRIEF SUMMARY OF THE INVENTION

The purpose of the present invention is that of making a folding assembly of a continuous sheet of packaging material, in particular paper, which is applicable to automatic packaging machines and which is structurally and constructively simple and which can be mounted in a simple and rapid manner without requiring specialised workers and without margins of error.

Another purpose of the present invention is that of making a folding assembly of a continuous sheet of packaging material, in particular paper, which can be applied to automatic packaging machines and which allows reducing the state of tension of the sheet and which allows, in particular, using also paper having low grammage and/or increasing the operative speed of the operating machines on which it is installed.

Another purpose of the present invention is that of making a folding assembly of a continuous sheet of packaging material, in particular paper, which can be applied to automatic packaging machines and which is particularly simple and functional, with low costs.

These purposes according to the present invention are achieved by making a folding assembly of a continuous sheet of packaging material, in particular paper, which can be applied to automatic packaging machines as outlined in claim 1.

Further characteristics are provided in the dependent claims.

BRIEF DESCRIPTION OF THE SEVERAL VIEWS OF THE DRAWINGS

The features and the advantages of a folding assembly of a continuous sheet of packaging material, in particular paper, which is applicable to automatic packaging machines and of an automatic packaging machine according to the present invention shall become clearer from the following description, given as an example and not for limiting purposes, with reference to the attached schematic drawings, in which.

DETAILED DESCRIPTION OF THE INVENTION

Figure 1:
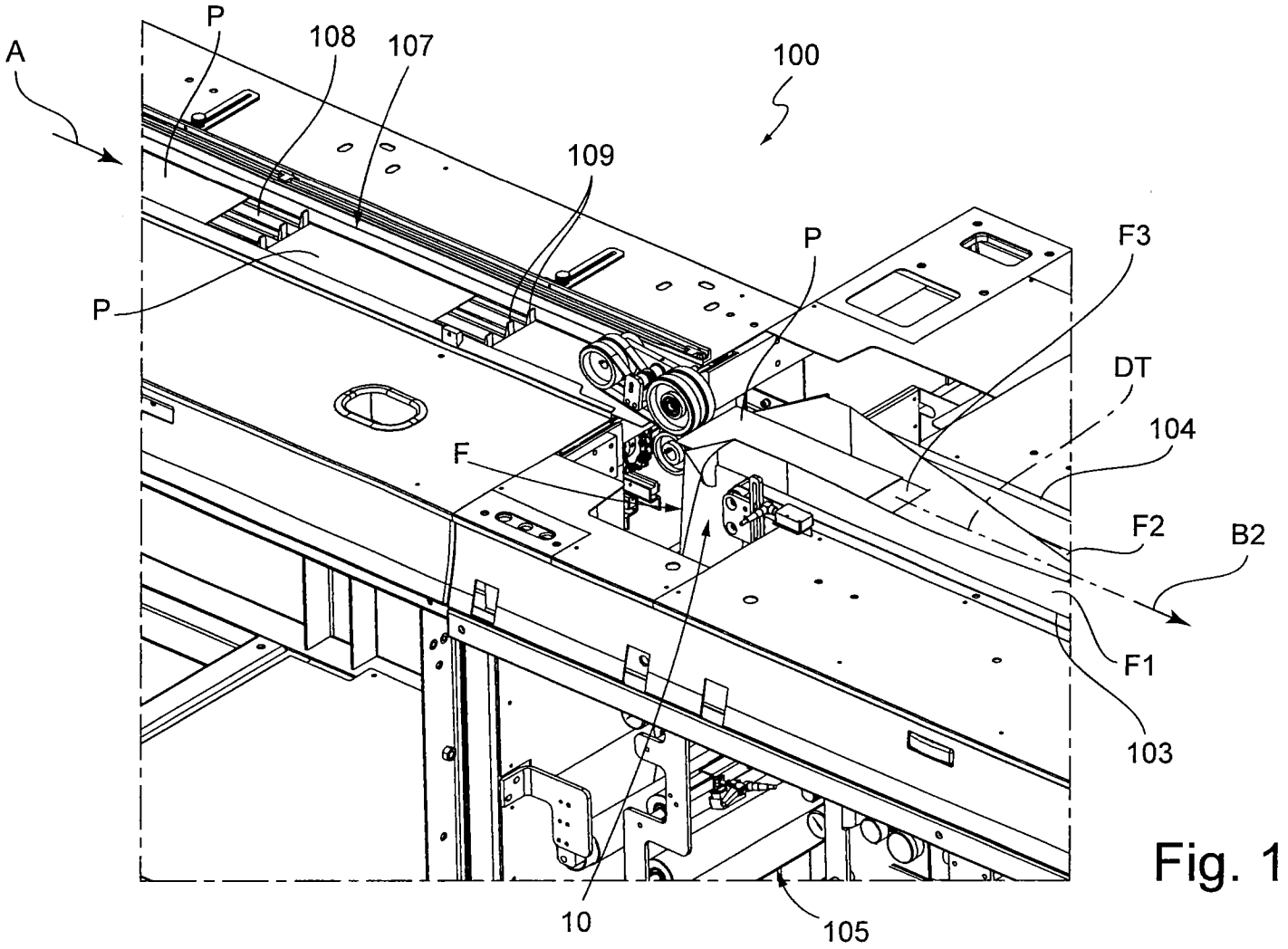
FIG. 1 is an axonometric view of a portion of an automatic packaging machine that is provided with a folding assembly according to the present invention.

With reference to the figures, reference numeral 10 wholly indicates a folding assembly of a continuous sheet of packaging material, in particular paper, according to the present invention.

The continuous sheet is made of packaging material consisting, in particular, of paper, although it should not be excluded the possibility that the continuous sheet be made of different packaging materials. In the rest of the description, for the sake of simplicity, reference will be made to a continuous sheet of paper.

The folding assembly 10 can be applied to an automatic packaging machine 100.

The machine 100 is of the type that is suitable for producing packages made of envelopes containing inside them a product P of the type, in particular, of a printed product, be it made of a sheet, a folded sheet, a fascicle, an insert or similar.

The machine 100, in particular, is of the type that is suitable for producing packages the envelope of which is made of a single front and of a back that is in turn made of two back flaps at least partially overlapping one another, in which the envelope can be closed at least at one of the opposite sides or longitudinally at the overlapping portion of the two back flaps.

The machine 100 is of the automatic and continuous operating type.

In it, the products P, which are made to advance one after the other and at a distance from one another, are fed on a continuous sheet of paper which is unwound in a continuous manner from a roll and rested onto a sliding plane by which it is transported along a conveying direction.

The opposite longitudinal flaps of the continuous sheet of paper on which the products P have been fed are folded upon one another so as to form the two back flaps, so as to obtain a flat and continuous tubular wrapper containing inside it a plurality of products P that are arranged in succession after one another and spaced apart from one another.

The flat and continuous tubular wrapper is then cut between two successive products P or pressed and cut at stripes of glue previously applied to the continuous sheet of paper between two successive products P so as to obtain single envelopes each of which contains a respective product P.

As the envelope format varies, the width of the front and/or the width of the longitudinal flaps that form the two back flaps and/or the amount of overlapping of the latter, besides the length of the single envelope vary.

The machine 100 of the type indicated above is per se known to the skilled person and is only partially represented in FIG. 1 and is herein described only with reference to the details that are useful for understanding the present invention.

The machine 100 comprises a sliding plane 101, in practice made of a continuous conveyor belt, for conveying a continuous sheet F of paper along a conveying direction indicated by the line DT. In the attached figures the sliding plane 101 is also schematically represented by the corresponding line also indicated with reference numeral 101.

The sliding plane 101 comprises an entrance end 102 for entering the sheet F and two opposite sides 103, 104 parallel to the conveying direction DT.

The machine 100 also comprises a feeding assembly 105 for feeding the sheet F along a feeding plane 106 which is orthogonal or substantially orthogonal to the conveying direction DT and is defined at the entrance end 102 of the sliding plane 101.

In the attached figures the feeding plane 106 is indicated by the corresponding line.

Figure 2B:
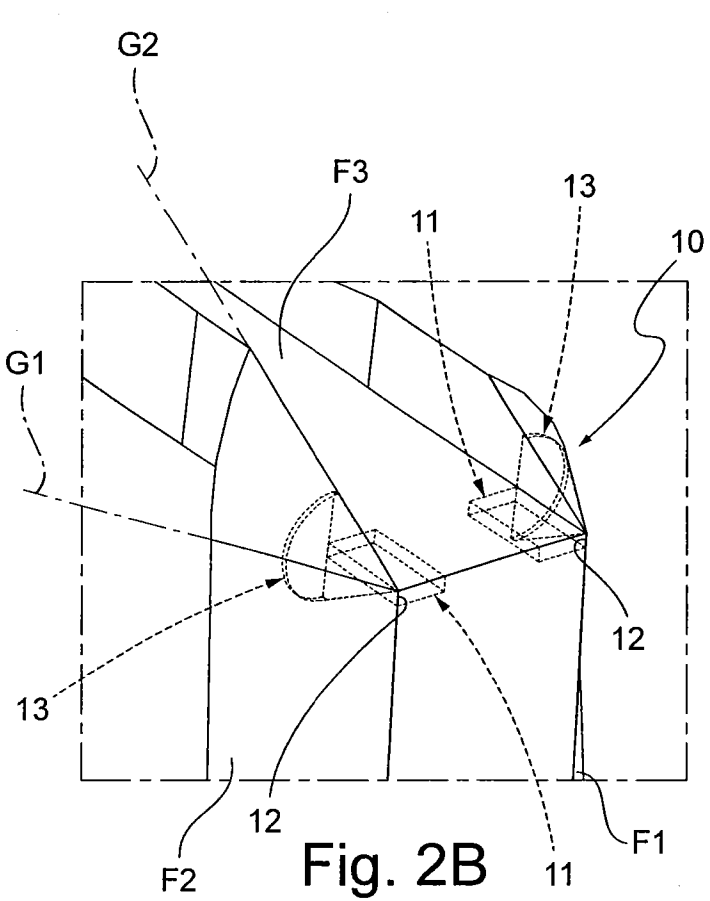
FIG. 2B is an enlarged detail of FIG. 2A.
Figure 2A:
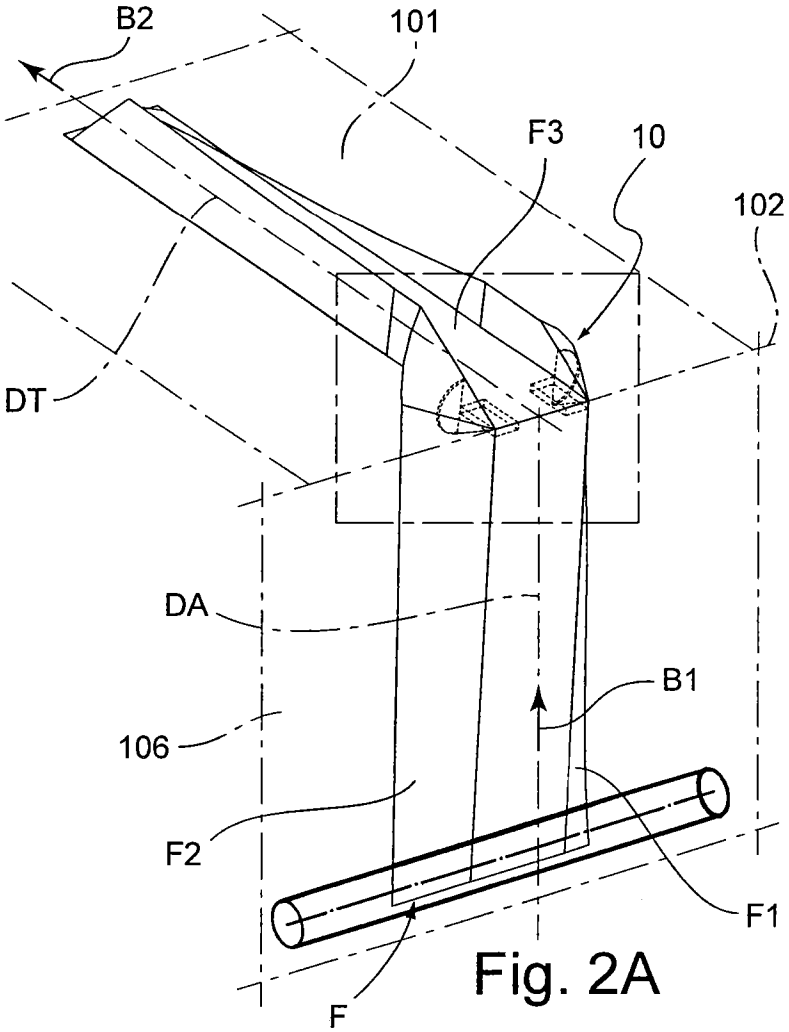
FIG. 2A schematically shows a folding assembly according to the present invention seen frontally according to the direction A indicated in FIG. 1.
Figure 2C:
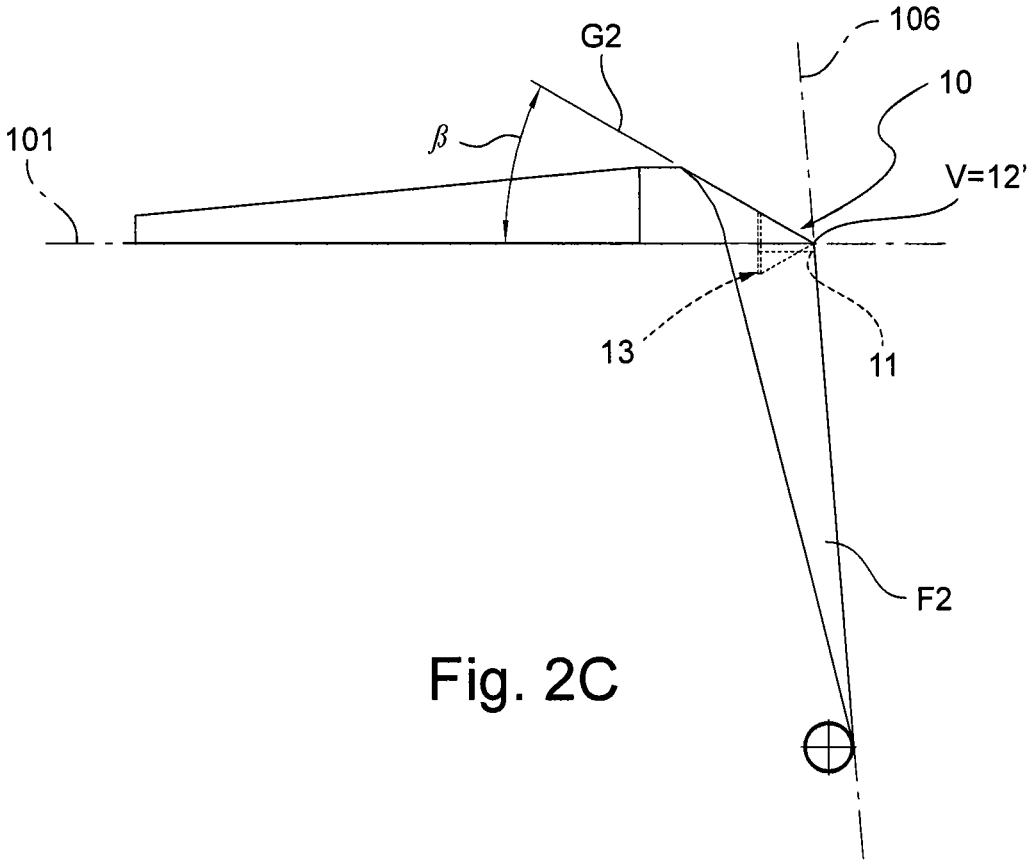
FIG. 2C is a side view of FIG. 2A.
Figure 2D:
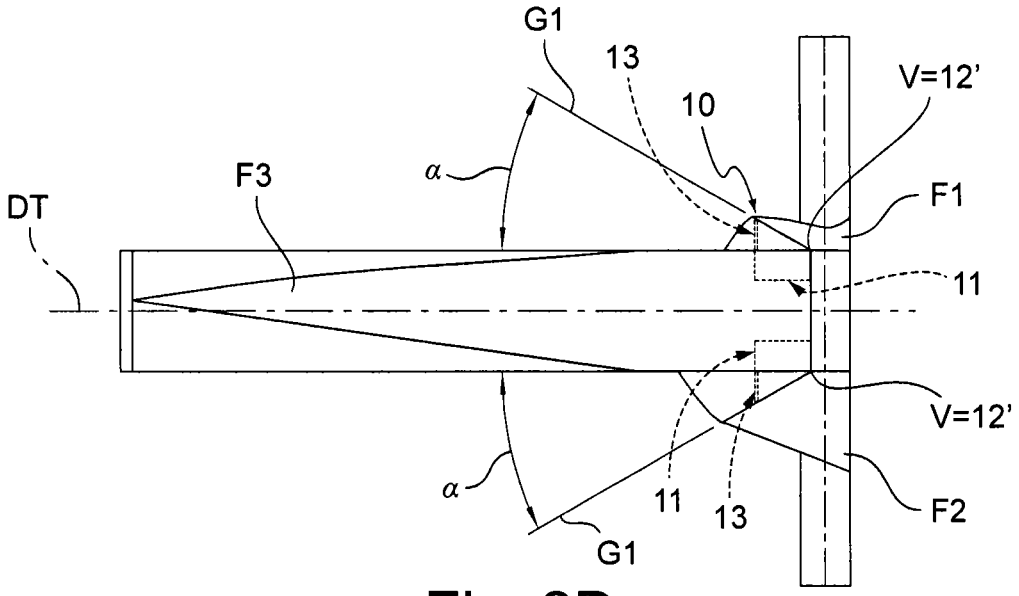
FIG. 2D is a top plan view of FIG. 2A.
Figure 3A:
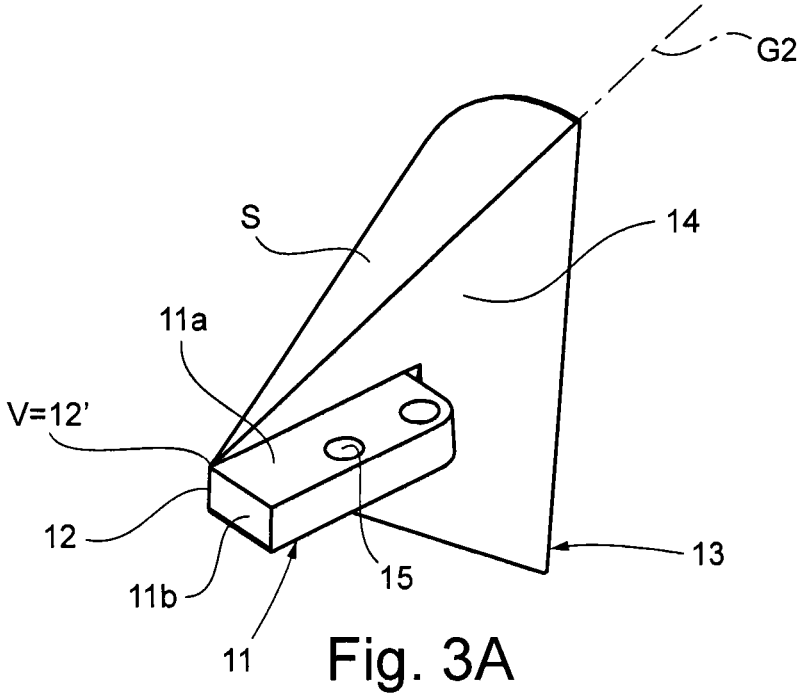
FIGS. 3A to 3D show a block and a body provided with a cone-sector surface of a first embodiment of the folding assembly according to the present invention in an axonometric view, front view, side view and top plan view, respectively.
Figure 3B:
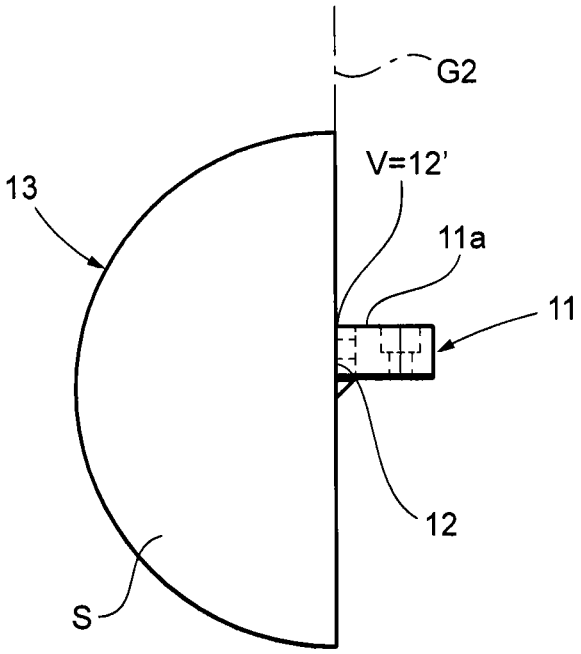
Figure 3C:
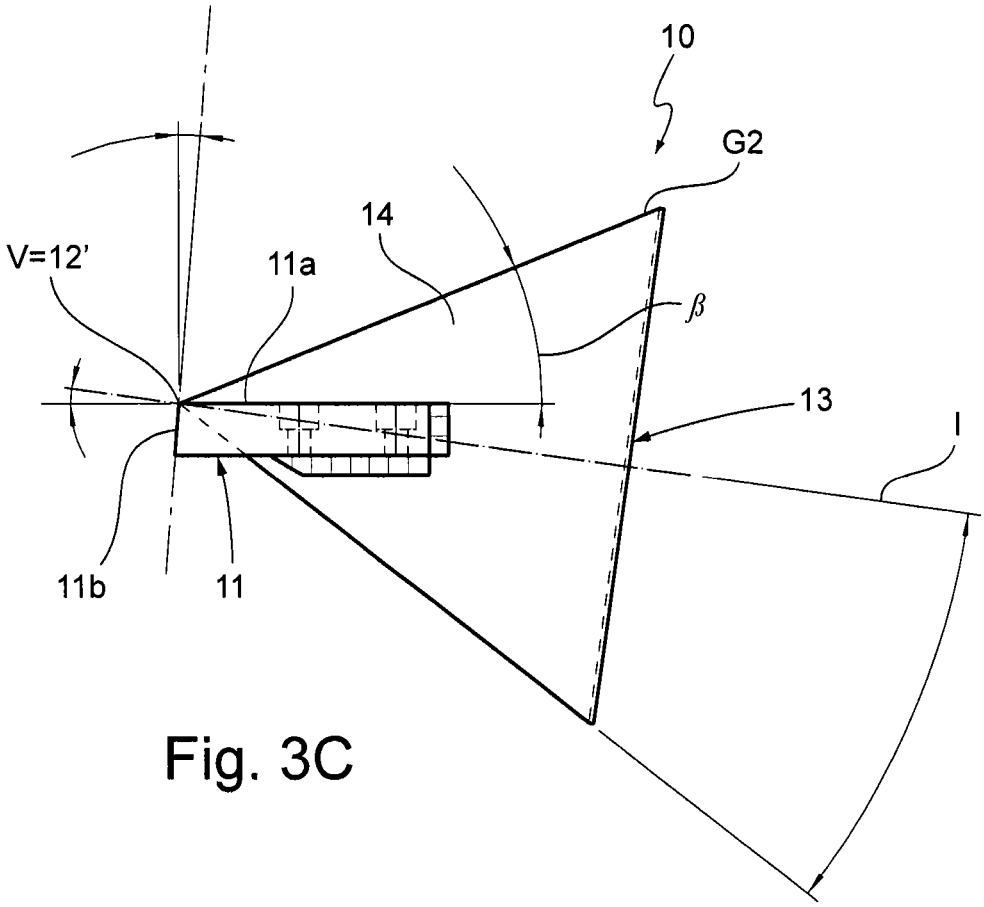
Figure 3D:
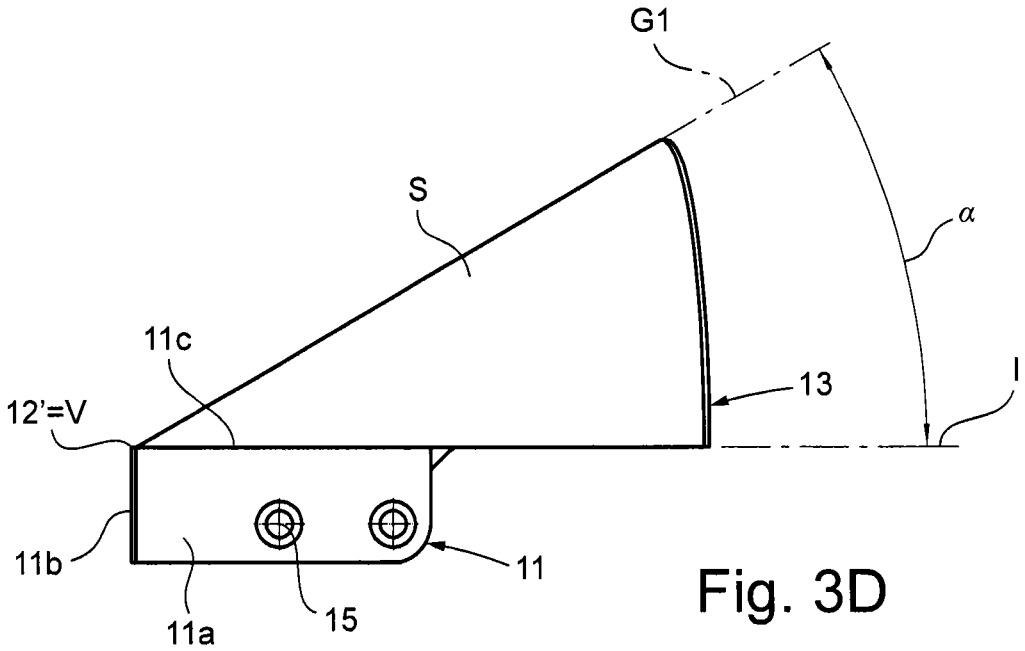
Figure 4A:
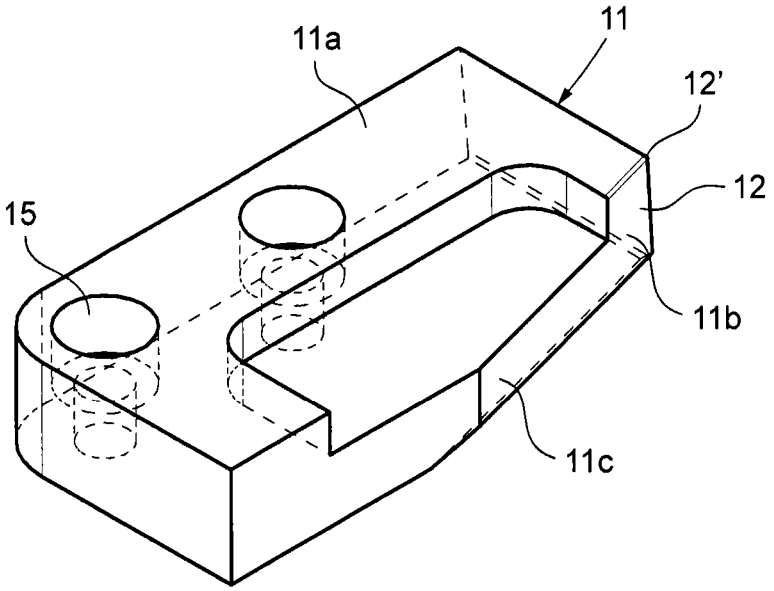
FIGS. 4A and 4B show a block of a second embodiment of the folding assembly according to the present invention in axonometric and side views, respectively.
Figure 4B:
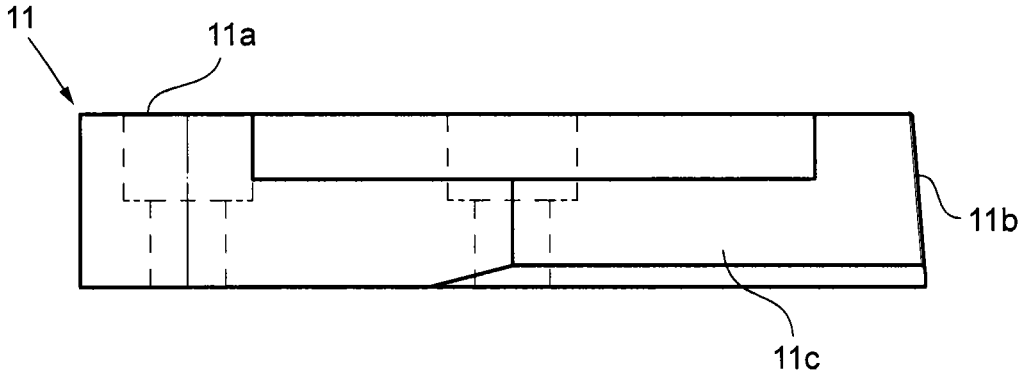
Figure 5A:
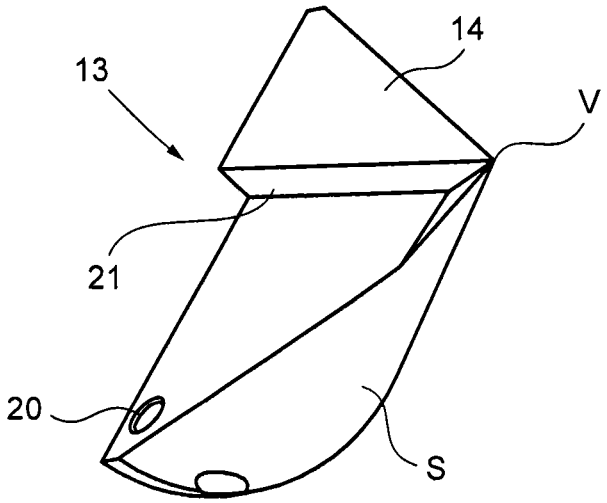
FIGS. 5A to 5D show a body that is provided with a cone-sector surface of the second embodiment of the folding assembly according to the present invention in an axonometric view, front view, side view and top plan view, respectively.
Figure 5B:
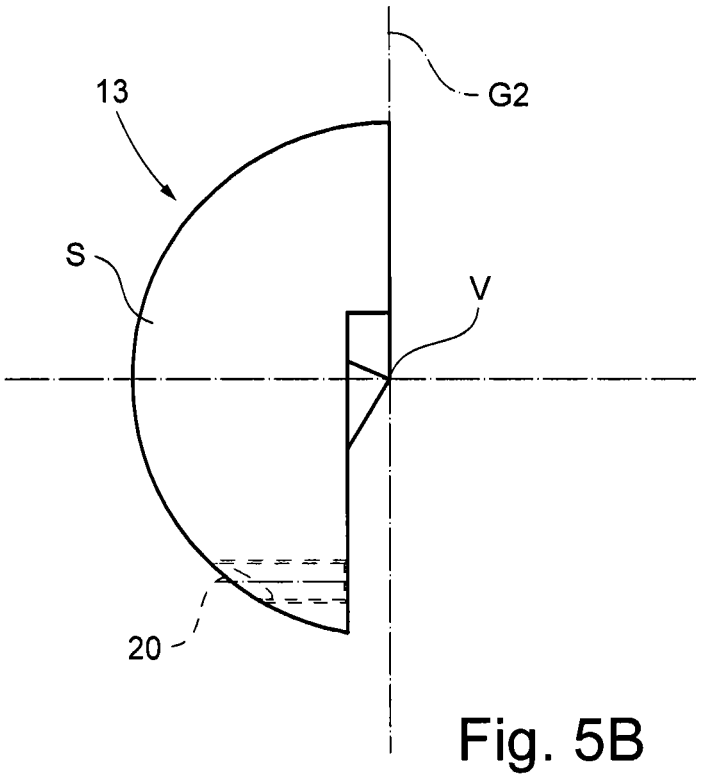
Figure 5C:
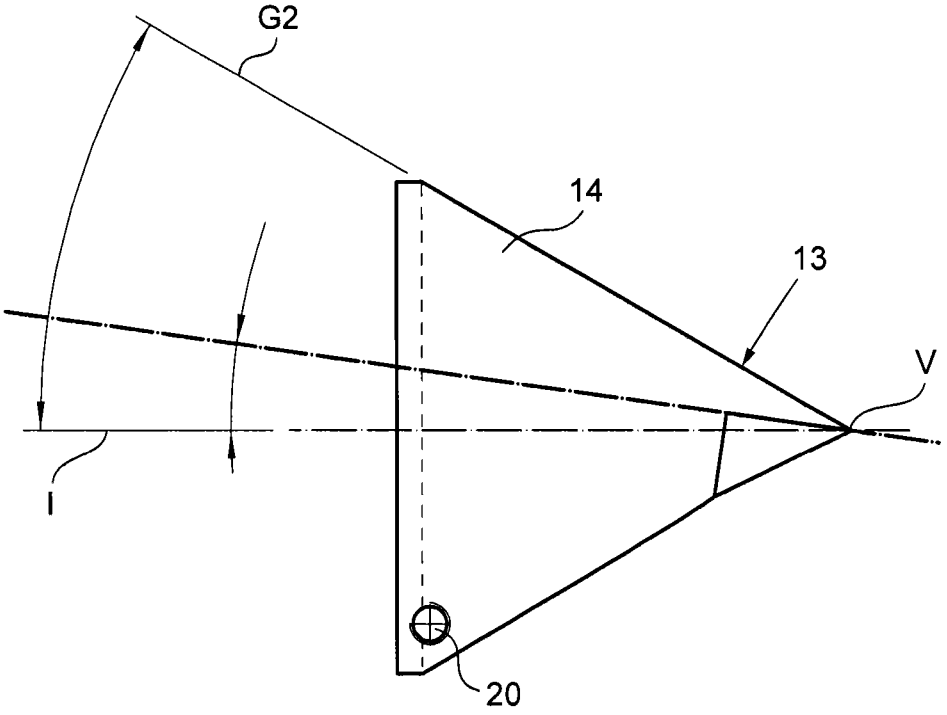
Figure 5D:
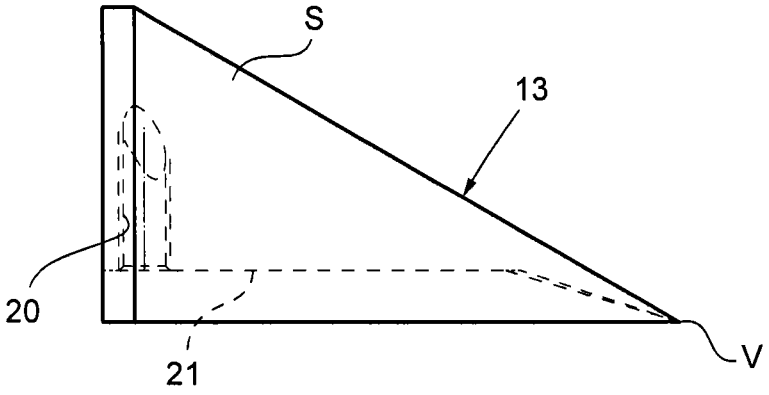
Figure 6A:
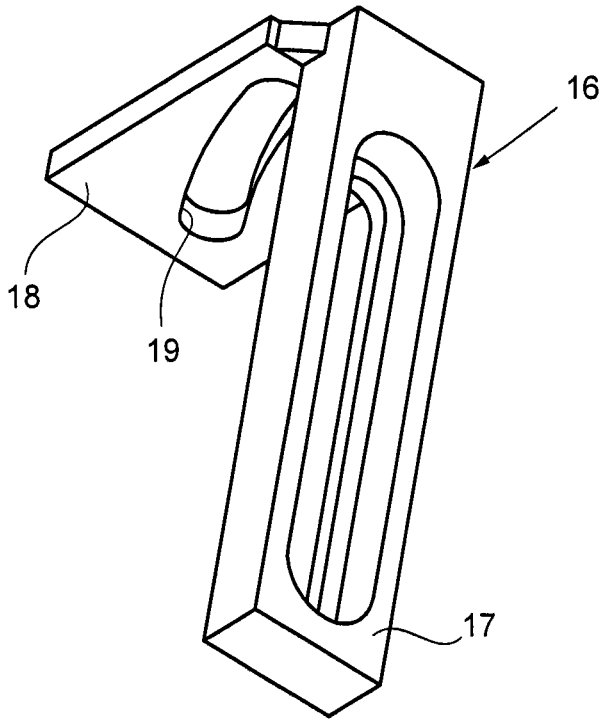
FIGS. 6A and 6B show an axonometric view and a side view, respectively, of a detail of the second embodiment of a folding assembly according to the present invention.
Figure 6B:
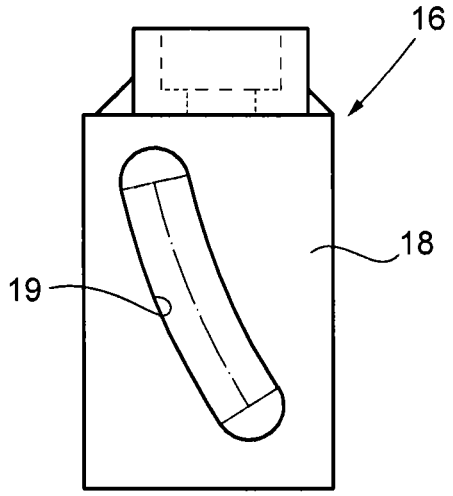

It is worth underlining that the feeding plane 106 is orthogonal or substantially orthogonal to the conveying direction DT within an angle that is generally less than 30° and, in particular, equal to 4°-5°, as schematically shown in FIG. 2C.

The feeding assembly 105 comprises a roll (not represented), which is made of a continuous sheet of paper and from which the sheet F is unwound, and a plurality of idler and tensioning rolls, by means of which the sheet F is deviated on the feeding plane 106 along a feeding direction of line DA that is orthogonal or substantially orthogonal to the sliding plane 101.

While passing from the feeding plane 106 to the sliding plane 101, the sheet F is thus deviated by a right or substantially right angle.

The feeding assembly 105 can moreover comprise devices for applying, on the face of the sheet F that, considering the sheet F resting on the sliding plane 101, faces upwards or in any case opposite to the sliding plane 101 itself, stripes of glue at portions of this face intended to constitute the side welding of the envelopes.

It is worth underlining that the feeding direction DA is orthogonal or substantially orthogonal to the sliding plane 101 within an angle that is generally less than 30° and, in particular, equal to 4°-5°, as shown schematically in FIG. 2C.

In the attached figures, moreover, arrows B1, B2 indicate the sense along which the sheet F advances along the feeding direction DA and along the conveying direction DT.

In practice, the sliding plane 101 is substantially horizontal and the feeding plane 106 is substantially vertical.

Upstream of the entrance end 102 of the sliding plane 101 there is a feeder 107 for feeding products P, of the type for example of printed products, to be packaged in single envelopes and which are fed one after the other at a distance from one another on the sheet F entering the sliding plane 101.

The feeder 107 is for example of the type with belts or chains 108 provided with a plurality of so-called "carriers" 109.

The folding assembly 10 is arranged at the entrance end 102 of the sliding plane 101 so as to define two opposite longitudinal flaps F1, F2 in the sheet F and accompany the overturning of these two longitudinal flaps from the feeding plane 106 to the sliding plane 101 and the folding thereof, at least partially overlapping one another, on the portion F3 of the sheet F which rests on the sliding plane 101 and onto which the products P have been fed one after the other and at a distance from one another (for the sake of making the representation easier in FIGS. 2A to 2D the products P are not shown).

Along the sliding plane 101 and downstream of the folding assembly 10 there are also devices for cutting or for pressing and cutting the flat tubular wrapper that is obtained starting from the sheet F and containing inside it the products P one after the other and at a distance from one another for obtaining single envelopes each containing a respective product P. These cutting devices or pressing and cutting devices are not shown since they are of the type known by a man skilled in the art.

The folding assembly 10 comprises for at least one or for each of the two opposite sides 103, 104 of the sliding plane 101, a respective block 11 which can be associated with the machine 100 at such at least one side 103, 104.

The block 11 can be fixed to the machine 100 through removable fixing means of the type known to skilled person and which, for example, can be of the threaded type.

The block 11 is provided with a rectilinear edge 12 which, considering the folding assembly 10 in the mounting configuration on the machine 100, faces the feeding plane 106 and is substantially parallel to the feeding direction DA so as to define a longitudinal creasing element of the sheet F for folding a corresponding longitudinal flap F1, F2 thereof.

A respective body 13 is associated to each block 11, said body being provided with a cone-sector surface S the vertex V of which is arranged at the outlet end 12' of the edge 12 from which the sheet F exits, said sheet being provided with longitudinal creasing, and which, considering the folding assembly 10 in the mounting configuration on the machine 100, has a conicity converging towards the entrance end 102 of the sliding plane 101.

This cone-sector surface S and its particular arrangement with respect to the block 11 supports without solution of continuity the corresponding longitudinal flap F1, F2 during the corresponding longitudinal creasing by the edge 12 and accompanies it during the overturning from the feeding plane 106 to the sliding plane 101 and the folding along the respective longitudinal creasing.

In greater detail, the block 11 has the shape of a polyhedron and comprises a first face 11*a* which, considering the folding assembly 10 in the mounting configuration on the machine 100, is arranged in a manner that is substantially coplanar or parallel to the sliding plane 101, a second face 11*b*, which is contiguous to the first face 11*a* and that, considering the folding assembly 10 in the mounting configuration on the machine 100, faces the feeding plane 106 and a third face 11*c* that is contiguous to the first face 11*a* and to the second face 11*b* and that, considering the folding assembly 10 in the mounting configuration on the machine 100, is arranged externally with respect to the side 103, 104 of the sliding plane 101.

The edge 12 is defined by the common edge of the first face 11*a*, second face 11*b* and the third face 11*c* and the vertex V of the cone-sector surface S is arranged at the common vertex of the first face 11*a*, second face 11*b* and third face 11*c*.

Advantageously, the first face 11*a*, the second face 11*b* and the third face 11*c* are plane; of these, moreover, the second face 11*b* forms with the first face 11*a* an angle that is different from a right angle by an angle less than 30° and preferably equal to 4°-5° as the inclination of the feeding plane 106, so that, considering the folding assembly 10 in the mounting configuration on the machine 100, the second face 11*b* is substantially parallel to the feeding plane 106.

The cone-sector surface S comprises a first generatrix G1 and a second generatrix G2 respectively for entering and exiting the corresponding longitudinal flap F1, F2.

Considering the axis I of the cone that defines the cone sector constituting the surface S, the first generatrix G1 forms with the axis I a first angle $\alpha$ comprised between 10° and 40° and the value of which is selected also in function of the angle of inclination of the feeding plane 106 with respect to the sliding plane 101.

Considering the folding assembly 10 in the mounting configuration on the machine 100, the first generatrix G1 lies in a plane that is substantially coplanar to the sliding plane 101.

With reference to the embodiments of the folding assembly 10 represented in the attached figures, in which the first face 11*a* of the block 11 is plane and intended, in the mounting configuration, to be arranged in a manner that is substantially coplanar to the sliding plane 101, the first generatrix G1 is substantially coplanar to the plane defined by the first face 11*a*.

The second generatrix G2, on the other hand, again considering the folding assembly 10 in the mounting configuration on the machine 100, lies on a plane that is orthogonal or substantially orthogonal to the sliding plane 101 and parallel to the conveying direction DT and forms, with the sliding plane 101 itself, a second angle β comprised between 20° and 40°.

Figure 7A:
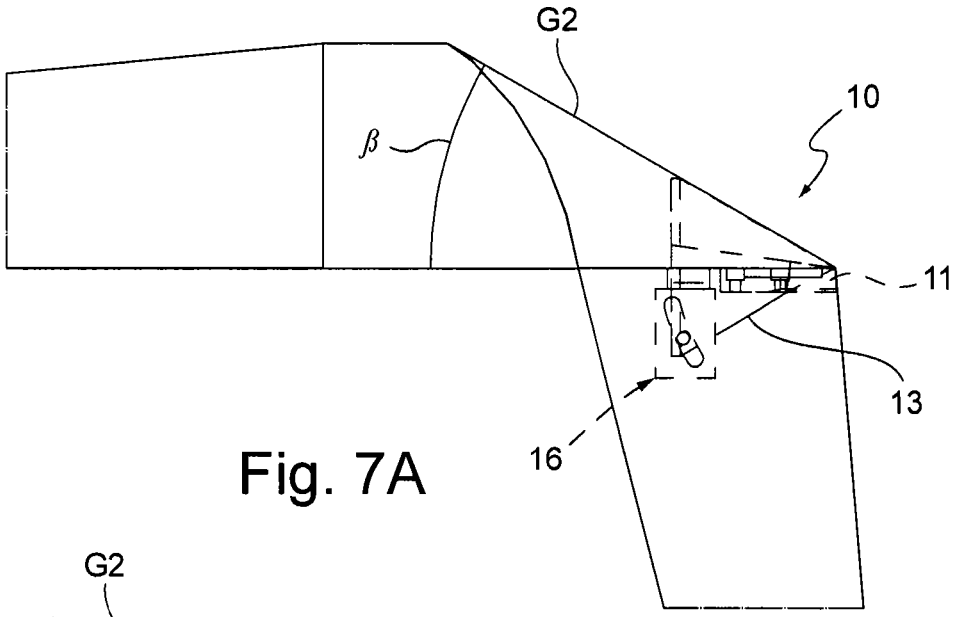
FIGS. 7A, 7B and 7C show a schematic side view of the second embodiment of the folding assembly according to the present invention in different positions.
Figure 7B:
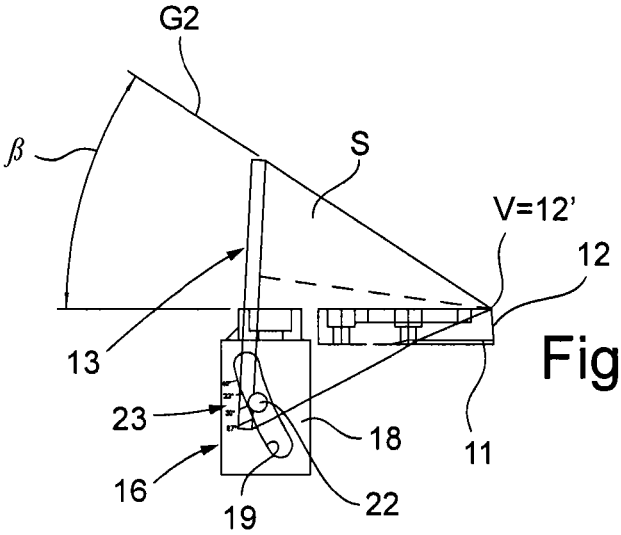
Figure 7C:
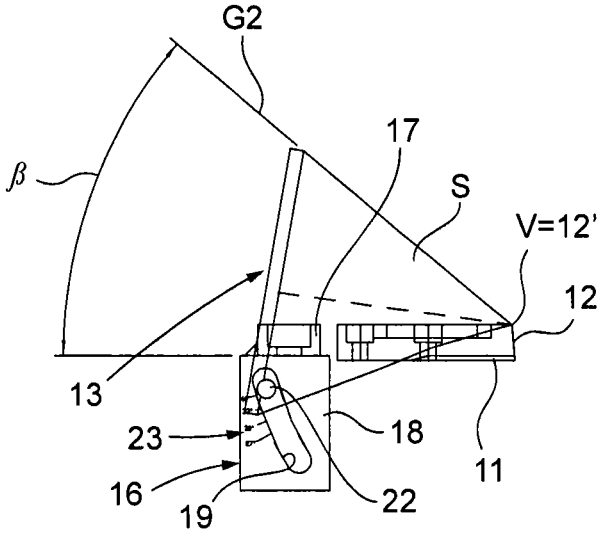

In the embodiment represented in the attached figures, the first angle α is equal to 30° and the second angle β is equal to 22°, in the embodiment represented in FIGS. 3A-3D and to 30°, in the embodiment represented in FIGS. 2A to 2D, whereas FIGS. 7A, 7B and 7C show different positions of the body 13 of the second embodiment of the folding assembly 10 and which vary from one another for the width of the second angle β respectively equal to 30°, 33° and 40°.

The first angle α and the second angle β can be equal to or different from one another; moreover, the first angle α and the second angle β of the cone-sector surface S arranged at one of the two opposite sides 103, 104 of the sliding plane 101 can be equal to or different from the first angle α and the second angle β of the cone-sector surface S arranged at the other of the two opposite sides 103, 104 of the sliding plane 101, according to the format of the envelope to be made.

Advantageously, at least one from the first angle α and the second angle β is defined by the angle of aperture of the cone the sector of which defines the surface S; the other one of said angles and of these in particular the second angle β, if different, can be obtained, as shall become clearer in the rest of the description, either by modifying the inclination of the axis I of the cone on a plane that is orthogonal to the sliding plane 101 and parallel to the conveying direction DT (FIGS. 4A to 6B), or by obtaining the body 13 as a single piece with the block 11 so that the axis I of the cone the sector of which defines the surface S, considering the folding assembly in the mounting configuration on a machine 100, is already inclined with respect to the sliding plane 101 by a certain angle (FIGS. 3A-3D).

The directrix of the cone sector that defines the surface S is, advantageously, made of an arc of circumference (the cross-section of the cone that defines the cone sector constituting the surface S consists, that is, of a circle); however, alternative embodiments are not excluded in which the directrix has always the shape of an arc of ellipse, ellipsoid or the like and non necessarily a circumference (the cross-section of the cone that defines the cone sector constituting the surface S can, that is, be made up of an ellipse, ellipsoid or the like).

The body 13, moreover, has a plane face 14 which contains the second generatrix G2 and that, considering the folding assembly 10 in the mounting configuration on the machine 100, extends orthogonally or substantially orthogonally with respect to the sliding plane 101 and parallel to the conveying direction DT in order to accompany the folding of the corresponding longitudinal flap F1, F2 along the respective longitudinal creasing.

In the embodiments represented in the attached figures, the plane face 14 is orthogonal with respect to the first face 11*a* of the respective block 11 and it contains the axis I of the cone that defines the cone sector constituting the surface S.

In the embodiment represented in FIGS. 3A to 3D, the block 11 and the body 13 are mutually associated in a rigid manner so as to form a unique body; in particular, they can be welded to one another.

The block 11 has a series of holes 15 for the passage of corresponding threaded members through which it is fixed to the frame of the machine 100 so that its first face 11*a* lies coplanar to the sliding plane 101.

In such an embodiment the axis I is inclined by an angle γ with respect to the first face 11*a* of the block 11 so that the second generatrix G2 is inclined with respect to such a first face 11*a* by a second angle β that is different from the angle of aperture of the cone that defines the cone sector constituting the surface S, wherein the first angle α is equal to the sum of the second angle β and the angle γ.

The first generatrix G1, on the other hand, forms with a plane that is orthogonal to the first face 11*a* and containing the axis I a first angle α, that is equal to the angle of aperture of the cone itself.

In the embodiment represented in FIGS. 4A to 7C, on the other hand, the body 13 and the block 11 are made of bodies which are obtained separately and which are mounted one on the other with the interposition of adjusting means for adjusting the inclination of the axis I of the cone that defines the cone-sector surface S on a plane that, considering the folding assembly 10 in the mounting configuration on the machine 100, extends orthogonally with respect to the sliding plane 101 and parallel to the conveying direction DT.

Such adjusting means comprise an L-shaped bracket 16 which has a first arm 17 that can be fixed to the block 11 or to a corresponding seat obtained in the sliding plane 101 through threaded members (not represented) and a second arm 18 that is provided with an arc-shaped slot 19 for adjusting the inclination of the body 13.

Along the slot 19 a pin 22 (not shown) is slidingly mounted, said pin being inserted into a corresponding through hole 20 that is obtained in the body 13, there also being provided means for fixing the position of the pin 22 and, therefore, of the body 13 with respect to the second arm 18.

Alongside the slot 19 a graduated reference scale 23 can be advantageously obtained.

The body 13, in this case, has a recess 21 for the coupling and the resting on the block 11.

As the envelope format to be made varies, the first angle α and the second angle β can be previously defined, said angles characterising the cone-sector surface S to be arranged respectively at the two opposite sides 103, 104 of the sliding plane 101, generating, for example, reference tables on the basis of which to arrange a plurality of assembly each made up of a block 11 and a body 13, be the latter made of separate bodies or of a single body.

In the case in which the block 11 and the body 13 are made of separate bodies, once the body 13 has been selected on the basis of the reference tables in function of the envelope format to be made, the mounting of the body 13 occurs in a simple and rapid manner, since it is sufficient to assemble it, with the aid of the adjusting means as described above, with the axis I that is inclined according to what is indicated in the table itself.

In the case in which, on the other hand, the block and the respective body 13 are made as a single piece in a single body, it is sufficient to select, on the basis of the reference tables and in function of the envelope format to be made, the piece (assembly made of the block 11 and body 13) to be mounted, the assembly of which occurs in a simple and rapid manner in a defined position for example through threaded members.

The folding assembly according to the present invention therefore has the advantage of being mounted in a simple and rapid manner, without the use of specialised workers and eliminating any discretion and error in mounting and adjusting it.

The folding assembly according to the present invention allows, therefore, drastically reducing the time necessary for setting the packaging machines on which it is installed whenever it is necessary to change the type of paper or the format of the package to be obtained.

The folding assembly according to the present invention, moreover, allows predefining, for each envelope format to be made, the block-body groups with a cone-sector surface to be used at the two opposite sides of the sliding plane, which must be only mounted in a predefined position without the possibility of error.

The folding assembly according to the present invention, moreover, also thanks to the continuity of the support offered to the continuous sheet of paper while passing from the feeding plane to the sliding plane, has the advantage of reducing the state of stress that the continuous sheet of packaging material undergoes, in particular paper; in particular, it allows reducing the overturning angle of the continuous sheet from around 270° to about 240°. This allows, on one hand, the packaging machine on which the folding assembly is installed to operate at speeds that are greater than those possible today for the same type of packaging material, in particular paper, and packaging format and, on the other hand, to use types of packaging material, in particular paper, also with low grammage and, therefore with a lower cost, that so far have not been used.

The folding assembly according to the present invention, finally, has a structure that is simple and not bulky and that allows lightening the structure of the packaging machine on which it is installed.

The folding assembly of a continuous sheet of packaging material, in particular paper, which can be applied to automatic packaging machines and the automatic packaging machine comprising such a folding assembly thus conceived can undergo numerous modifications and variants, all covered by the invention; moreover, all the details can be replaced by technically equivalent elements. In practice the materials used, as well as the dimensions, can be any according to the technical requirements.

The invention claimed is:

1. An automatic packaging machine including a folding assembly, the folding assembly comprising:

a sliding plane for conveying a continuous sheet of packaging material along a conveying direction, said sliding plane comprising an entrance end for entering said continuous sheet of packaging material and two opposite sides parallel to said conveying direction;

a feeding assembly for feeding said continuous sheet of packaging material along a feeding plane which is substantially orthogonal to said conveying direction;

at least one block fixed to the machine at said entrance end and along at least one of the two opposite sides of said sliding plane, the at least one block having a rectilinear edge facing said feeding plane and substantially parallel to said feeding direction so as to define a longitudinal creasing element of said continuous sheet of packaging material for folding a corresponding longitudinal flap thereof; and a body associated with said at least one block, said body provided with a cone-sector surface having a vertex arranged at an outlet end of said rectilinear edge at which said continuous sheet of packaging material provided with said longitudinal creasing exits, and said cone-sector surface having a conicity converging towards said entrance end of said sliding plane, wherein said continuous sheet of packaging material is fed along said feeding plane according to a feeding direction substantially orthogonal to said sliding plane and is deviated by a substantially right angle while passing from said feeding plane to said sliding plane, and wherein said cone-sector surface supports said longitudinal flap during said longitudinal creasing and accompanies it during the folding along said longitudinal creasing.

2. The folding assembly according to claim 1, wherein said cone-sector surface comprises a first entrance generatrix for entering said corresponding longitudinal flap which forms with an axis of a cone of said cone-sector surface a first angle $\alpha$ comprised between 10° and 40°.

3. The folding assembly according to claim 2, wherein said first generatrix lies in a plane substantially coplanar to said sliding plane.

4. The folding assembly according to claim 1, wherein said cone-sector surface comprises a second exiting generatrix for exiting said corresponding longitudinal flap which lies on a plane substantially orthogonal to said sliding plane and parallel to said conveying direction and forms with it a second angle $\beta$ comprised between 20° and 40°.

5. The folding assembly according to claim 4, wherein said body has a plane face which contains said second generatrix and extends substantially orthogonally to said sliding plane and parallel to said conveying direction in order to accompany the folding of said longitudinal flap along said longitudinal creasing.

6. The folding assembly according to claim 1, wherein said block is attached to said body so as to form a unique body.

7. The folding assembly according to claim 1, wherein said block is attached to said body with an adjusting means interposed therebetween for adjusting an inclination of an axis of a cone of said cone-sector surface on a plane that extends orthogonally to said sliding plane and parallel to said conveying direction.

8. The folding assembly according to claim 1, wherein said block has a shape of a polyhedron with a first face which is arranged in a manner substantially coplanar or parallel to said sliding plane, a second face which is contiguous to said first face and which faces said feeding plane, and a third face contiguous to said first face and to said second face, wherein an edge common to said first face, said second face, and said third face defines said longitudinal creasing element of said continuous sheet of packaging material, and wherein the vertex of said cone-sector surface is arranged at a vertex common to said first face, said second face, and said third face.

* * * * *